United States Patent [19]

Greiner, II

[11] 4,083,521

[45] Apr. 11, 1978

[54] ANCHORING DEVICE FOR CLIMBING ROPES

[76] Inventor: John N. Greiner, II, 313 High St., Klamath Falls, Oreg. 97601

[21] Appl. No.: 755,265

[22] Filed: Dec. 29, 1976

[51] Int. Cl.[2] ..... A47G 29/00
[52] U.S. Cl. ..... 248/1
[58] Field of Search ..... 248/1

[56] References Cited

U.S. PATENT DOCUMENTS

| | | | |
|---|---|---|---|
| 3,946,975 | 3/1976 | Lyman | 248/1 |
| 3,957,237 | 5/1976 | Campbell | 248/1 |

OTHER PUBLICATIONS

Bill Dolt, Doltchocks & Things 3/1969.

*Primary Examiner*—Robert A. Hafer
*Attorney, Agent, or Firm*—Julian Caplan

[57] ABSTRACT

The device is placed in crevices of rocks or walls to secure a rope during climbing; it is later removed. The shape in end elevation is "trefoil" (i.e., three equiangularly spaced arms extending from a center, the ends of the arms being rounded) and in side elevation is preferably trapezoidal. Two intersecting holes are formed in the device across the bases of the two wider arms. A sling passes through the holes and serves to receive climbing rope elements. In a modification, a second set of two intersecting holes, each parallel to the first holes, are spaced from the first set for a second sling.

5 Claims, 5 Drawing Figures

ANCHORING DEVICE FOR CLIMBING ROPES

This invention relates to a new and improved anchoring device for climbing ropes. Preferably, the device is inserted in a crevice with a sling passing through holes formed in the device. A ring or carabiner is received in the sling and a climbing rope slides in the ring or carabiner.

A particular feature of advantage of the device is the fact that it is easily placed by hand or other means in flaws, cracks or irregular formation and is likewise easily retrieved after use.

The device is versatile for use in many natural or man-made formations where the camming or wedging action which is inherent in the device is required to support a rope. The three points of contact of the device provide great strength and stability in anchoring a rope.

When no tension is applied on the rope, the device maintains its position and is instantaneously available to anchor against sudden or unexpected loads or shocks. When tension is applied to the rope, a stable anchor results from the wedging or camming action. When the tension is released, the locking action ceases.

The camming action heretofore mentioned is a result of the shape of the device and also the hole location.

The device may be fabricated from extruded plastic or metal standard stock or special shapes and is fabricated by sawing lengths of the stock and drilling holes in suitable locations. Alternatively, the device may be cast.

Other objects of the present invention will become apparent upon reading the following specification and referring to the accompanying drawings in which similar characters of reference represent corresponding parts in each of the several views.

Figure 1:
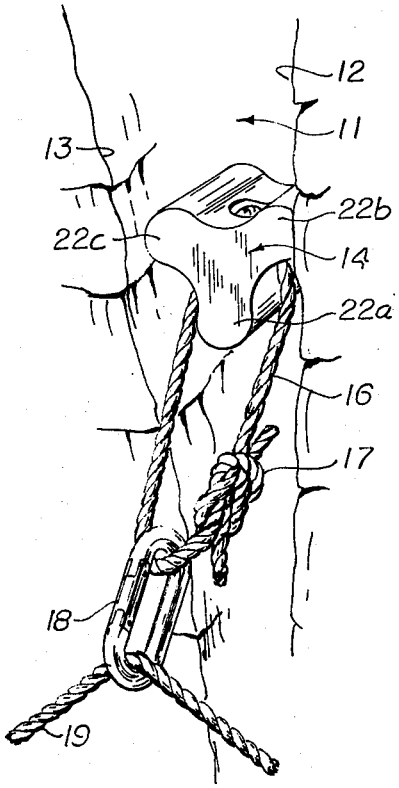
FIG. 1 is a fragmentary perspective view showing one location in which the device is used ans also showing climbing gear in place.

FIG. 1 illustrates one site suitable for installation of the device of the present invention. A flaw, crack or crevice 11 is illustrated having downward converging side edges 12, 13. It will be understood that this location is merely typical of the many locations in which the device is used. The formation, however, should have a crevice 11 with downward converging walls 12, 13.

The device 14 is termed herein a "trefoil" and is of plastic or metal, light in weight, strong, and of a shape hereinafter defined.

Figure 3:
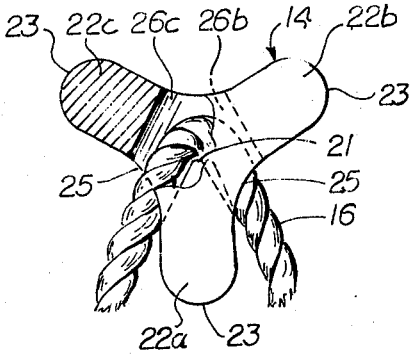
FIG. 3 is an end elevation partly broken away in section to reveal internal construction.
Figure 2:
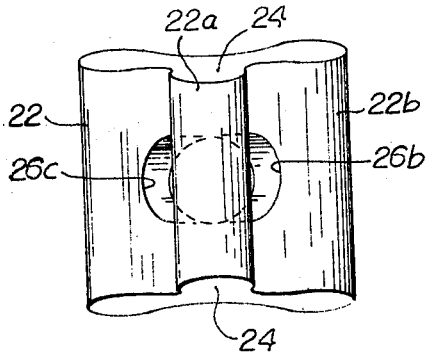
FIG. 2 is an enlarged bottom plan view of the device.
Figure 4:
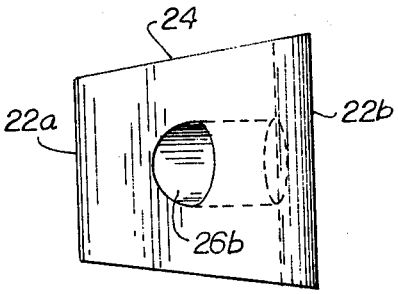
FIG. 4 is a side elevational view of the structure of FIG. 2.

The device 14 has a center indicated by reference numeral 21 from which, as viewed in end elevation in FIG. 3, extend three arms *22a, 22b, 22c* equiangularly spaced 120° apart and of equal length. The outer ends 23 of each of the arms is rounded and the junctures of the arms are rounded in large radius fillets 25. The shape may be a standard plastic or metal extrusion. In a preferred form of the invention, as best shown in FIG. 4, in side elevation the device is trapezoidal in that the end walls 24 converge toward the arm *22a*. The arm *22a*, as best shown in FIG. 1, is preferably downmost in position of use.

Holes *26b, 26c* are formed in the device at the base of the arms *22b, 22c* (see especially FIG. 3) and the holes *22b, 22c* intersect at the rounded portion 25 beteen the arms *22b, 2c*, their intersection being exposed. The holes *22b, 22c* pass to either side of the center 21.

Accordingly, the sling 16 is inserted through holes *26b, 26c*, and a knot 17 formed therein. The exposed intersection of the two holes facilitates installing the sling 16. When a downward pull is applied to the sling 16, the arms *22b, 22c* wedge against the sides 12, 13, and the arm *22a* is pulled backwards so that, if possible, it is forced against the back (not shown) of the crack 11.

The device 14 may be placed in the crack 11 by hand or by a stick which is used to extend it into place. Once in position, a pull on the rope 19 cams the device 14 into position. After use of the device 14 is unnecessary, it may be pulled upward by the climber.

Figure 5:
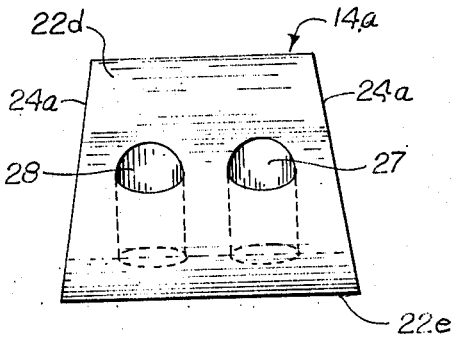
FIG. 5 is a view similar to FIG. 4 of a modification which is larger and employs two sets of holes.

The modification of FIG. 5 is similar to the modification of FIGS. 1–4, except that it is somewhat larger. Two holes 27, 28 are formed in the device *14a* below the arm *22b* and at the base of the arms *22e* and *22f* (not shown). The arms of the device of FIG. 5 are similar to those of the preceding modification and are designated *22d, 22e* and *22f*. In other respects, the device of FIG. 5 is similar to that of the preceding modifications, and the same reference numerals followed by the subscript *a* are used to designate corresponding parts.

What is claimed is:

1. A climbing device adapted to be placed in a crevice to support the weight of a climber comprising a body having three symmetrical, equiangularly spaced projecting arms, said body having a large radius of curvature at the junctures of said arms, said body being formed with a passageway through which a sling may pass, said passageway comprising two bores each extending from a common center of said body outward to the juncture of two of said arms.

2. A device according to claim 1 in which the outer ends of said arms are rouned.

3. A device according to claim 1 in which in side elevation the device is a trapezoid, the thickness of one of said arms being less than that of the other two.

4. A device according to claim 1 in which said body is formed with a second passageway parallel to said first-mentioned passageway.

5. A climbing device adapted to be placed in a crevice to support the weight of a climber comprising a body having three projecting arms, said body being formed with a passageway through which a sling may pass, said passageway comprising two bores each extending from a common center of said body outward to the juncture of two of said arms, said passageway also extending from said common center of said body outward to the juncture of the remaining two arms.

* * * * *